US010454225B2

(12) United States Patent
Wilfer

(10) Patent No.: US 10,454,225 B2
(45) Date of Patent: Oct. 22, 2019

(54) PLUG CONNECTOR

(71) Applicant: Hans-Peter Wilfer, Markneukirchen (DE)

(72) Inventor: Hans-Peter Wilfer, Markneukirchen (DE)

(73) Assignee: Hans-Peter Wilfer, Markneukirchen (DE)

( * ) Notice: Subject to any disclaimer, the term of this patent is extended or adjusted under 35 U.S.C. 154(b) by 1 day.

(21) Appl. No.: 15/861,029

(22) Filed: Jan. 3, 2018

(65) Prior Publication Data

US 2019/0097367 A1 Mar. 28, 2019

(30) Foreign Application Priority Data

Sep. 26, 2017 (DE) ..... 10 2017 122 241

(51) Int. Cl.

| | |
|---|---|
| ***H01R 13/60*** | (2006.01) |
| ***H01R 24/58*** | (2011.01) |
| ***H01R 13/405*** | (2006.01) |
| ***H01R 24/50*** | (2011.01) |
| ***H01R 24/62*** | (2011.01) |
| ***H01R 31/02*** | (2006.01) |
| ***H01R 31/06*** | (2006.01) |
| *H01R 13/17* | (2006.01) |
| *H01R 103/00* | (2006.01) |
| *H01R 35/00* | (2006.01) |

(52) U.S. Cl.

CPC ..... *H01R 24/58* (2013.01); *H01R 13/405* (2013.01); *H01R 24/50* (2013.01); *H01R 24/62* (2013.01); *H01R 31/02* (2013.01); *H01R 31/06* (2013.01); *H01R 13/17* (2013.01); *H01R 35/00* (2013.01); *H01R 2103/00* (2013.01)

(58) Field of Classification Search

CPC ..... H01R 24/58; H01R 31/06; H01R 24/50; H01R 13/17; H01R 13/405; H01R 31/02; H01R 24/62; H01R 2103/00

USPC ..... 439/131, 171, 173, 172, 174, 272, 638, 439/11, 640, 8

See application file for complete search history.

(56) References Cited

U.S. PATENT DOCUMENTS 4,794,315 A * 12/1988 Pederson ..... F21L 4/085 200/61.58 R
4,997,381 A * 3/1991 Oh ..... H01R 27/00 439/131
5,006,779 A * 4/1991 Fenne ..... F21L 4/08 320/111
5,159,545 A * 10/1992 Lee ..... H01R 31/065 363/146
5,687,387 A * 11/1997 Endejan ..... G06F 1/1601 439/638
5,716,219 A * 2/1998 Noike ..... H01R 27/00 439/173
5,791,921 A * 8/1998 Lee ..... H01R 27/00 439/103

(Continued)

*Primary Examiner* — Abdullah A Riyami
*Assistant Examiner* — Nelson R. Burgos-Guntin
(74) *Attorney, Agent, or Firm* — Scarinci Hollenbeck, LLC; Libby Babu Varghese

(57) ABSTRACT

The invention relates to a plug connector having a housing, from which a first plug emerges, which is fixedly arranged relative to the housing, wherein a second plug that can be slid along a displacement surface of the housing is arranged on the housing such that the relative position between the first plug and the second plug can be changed.

15 Claims, 5 Drawing Sheets

(56) References Cited

U.S. PATENT DOCUMENTS

| | | | | |
|---|---|---|---|---|
| 7,658,625 | B2 * | 2/2010 | Jubelirer | H01R 31/065 439/131 |
| 7,997,929 | B2 * | 8/2011 | Montena | H01R 9/0524 439/578 |
| 8,323,040 | B2 * | 12/2012 | Prest | H01R 35/00 439/131 |
| 8,870,601 | B2 * | 10/2014 | Lee | H01R 31/06 439/131 |
| 9,059,547 | B2 * | 6/2015 | McLawhorn | A61B 18/14 |
| 2002/0173187 | A1 * | 11/2002 | Schmitt | H01R 31/06 439/171 |
| 2004/0038572 | A1 * | 2/2004 | Liu | H01R 31/06 439/172 |
| 2010/0279553 | A1 * | 11/2010 | Izumi | H01R 23/26 439/669 |
| 2011/0059648 | A1 * | 3/2011 | Montena | H01R 9/05 439/578 |
| 2011/0157801 | A1 * | 6/2011 | Satterfield | G06F 1/1607 361/679.01 |
| 2014/0277643 | A1 * | 9/2014 | Villarreal | H01R 24/58 700/94 |

* cited by examiner

PLUG CONNECTOR

This application claims priority to foreign German application DE102017122241.3 filed on Sep. 26, 2017.

BACKGROUND

This invention relates to a plug connector for connecting two sockets, and also to an assembly comprising a plug connector.

In the music sector, connections are needed for interconnecting foot-operated effect devices that are used for modifying the electric sound of an electronic musical instrument such as an electric guitar or an electric bass guitar. As a rule, a plurality of such devices are interconnected in series in order to form a signal chain, in which effects can be turned on and off independently of one another for a broad spectrum of sound modifications. Such signal chains are used especially in live concerts by guitarists and bassists.

For easy transport of the already hooked up effect devices, the latter are often attached in the hooked up state to a transport element such as panel. Because the effect devices to be connected are very different in terms of their shape and arrangement of the sockets to be connected, short patch cables are typically used for connection in order to permit a compact and space-saving arrangement of the effect devices.

However, connections with patch cables are associated with disadvantages. For one thing, patch cables are typically longer than the connection sections that need to be bridged so that when effect devices are arranged in a compact assembly, excess cable remains, which is stuffed into the gaps left between the effect devices. This leads to more mechanical stress on the patch cables, frequently causing them to break. Furthermore, additional space is needed for stowing the excess cable, which makes for a less compact assembly of the effect devices.

The problem addressed by the invention is therefore that of specifying a connection solution that permits a sturdy, reliable, and space-saving connection of two sockets a short distance apart under varying external conditions.

BRIEF SUMMARY OF THE INVENTION

This problem is solved by a plug connector having the features of claim 1. The problem is furthermore solved by an assembly having the features of claim 14.

This problem is solved in particular by a plug connector having a housing, from which a first plug emerges, which is fixedly arranged relative to the housing, wherein a second plug capable of being slid along a displacement surface is arranged on the housing, in order to change the relative position between the first plug and the second plug.

An essential idea of the invention lies in the fact that the plugs provided for connection are arranged on a fixed housing and, unlike the usual case, not connected by a cable section. A sturdy connection solution, which is less susceptible to mechanical stress, is thus achieved. One of the plugs is thus slidably mounted on the housing such that the relative position of the plugs to one another can be changed in order to accommodate varying arrangements of the sockets to be connected. The plug connector according to the invention thus has the decisive advantages of standard connections in terms of the flexibility in positioning the plugs, but without the disadvantages thereof.

In a preferred embodiment, the displacement surface has a guide slot for guiding the second plug. The guide slot defines a path along which the second plug can be slid. The width of the guide slot preferably corresponds to the outer diameter of the second plug. A wobbling of the second plug in the guide slot can thus be avoided.

Further preference is given to a strip conductor being arranged in the housing, which can be connected in an electrically conductive manner to an electric contact of the first plug and which is arranged such that an electric contact of the second plug is in contact with the strip conductor in every position of the second plug. A constructionally simple and mechanically sturdy solution for the electrical connection between the two plugs is thus achieved. The strip conductor preferably extends within the housing parallel to the guide slot such that the second plug does not change its orientation relative to the plane of the displacement surface as it is slid along the direction of the guide slot.

In a preferred embodiment, the strip conductor is arranged on the front side of an insulating plate that faces the guide slot. An advantageous solution for mounting the strip conductor inside the housing is thus achieved. The circuit board can be glued, inserted, or screwed in the housing. It is possible to adapt the contour of the circuit board to the shape of the housing so that it will fit in the housing. The insulating plate can have a hole on its side facing away from the strip conductor, which extends in the direction of the front side to the strip conductor. This makes it possible to connect the electric contact of the first plug to the strip conductor from the back side of the insulating plate.

Further preference is given to the insulating plate being formed by a circuit board and to the strip conductor being imprinted on the insulating plate. The strip conductor can thus be produced easily and inexpensively.

In another preferred embodiment, the second plug has an insulating washer on its end arranged in the housing. The sheath of the plug can thus be reliably insulated from the contact zone of the electric contact of the second plug with the strip conductor. The insulating washer is preferably configured as protruding radially outwards from the second plug.

Further preference is given to the second plug, particularly the insulating washer, engaging with a spring element in such a way that the second plug can be pretensioned along its plug axis toward the strip conductor. This ensures that the electric contact of the second plug remains in contact with the strip conductor.

In a preferred embodiment, a washer is formed on the second plug in such a way that it abuts on an outside of the housing in every position of the second plug. The washer supports the second plug on the housing and thus increases the stability of the plug connector. The guiding of the second plug along the guide slot is improved at the same time.

In a preferred embodiment, the first plug is arranged on a first housing side of the housing and the second plug is arranged on a second housing side of the housing opposite the first housing side. A plug connector is thus created, with which two sockets situated on opposing (housing) surfaces can be connected. Because the second plug is displaceable, the sockets can also be interconnected if they are arranged offset in relation to one another on the respective surfaces.

Further preference is given to the housing side and the displacement surface being essentially parallel to one another. In this case, the axes of the first plug and the second plug are essentially parallel to one another such that two sockets in parallel alignment to one another can be connected with the plug connector.

In another preferred embodiment, the housing sides and the displacement surface mutually form an acute angle. With a plug connector thus configured, a connection can be established between sockets that are not in parallel alignment to one another.

In a further preferred embodiment, an angle between a first plug-in direction defined by the first plug and a second plug-in direction defined by the second plug is 90°. With this plug connector, it is possible to interconnect two sockets whose plug-in directions are at right angles to each other.

In a further preferred embodiment, an angle between a first plug-in direction defined by the first plug and a second plug-in direction defined by the second plug is greater than 0°, in particular 180°. This embodiment excludes a plug connector in which the first plug and the second plug are arranged parallel to one another and oriented in the same direction.

Further preference is given to the first plug and the second plug being configured as jack plugs, preferably as two-pole jack plugs, more preferably as two-pole 6.3 mm jack plugs. Preference is given herein to the electric contacts of the two plugs each being connected to the tips of the plugs, whereas the sheaths of the plugs are grounded. A plug connector is thus created that can be used with all common effect devices having 6.3 mm pin jacks.

The problem addressed by the invention is furthermore solved by an assembly comprising at least two effect devices for modifying the electronic sound of a musical instrument, which each have a socket via which they are interconnected with one or several plug connectors according to any one of claims 1-13. By using the plug connector according to the invention, it is possible to create an assembly out of several effect devices, which has a space-saving and sturdy connection and which is achievable when the sockets are in different positions on the effect devices.

BRIEF DESCRIPTION OF THE DRAWINGS

The invention is explained, also with respect to further features and advantages, in more detail in the following on the basis of the description of design examples and with reference to the accompanying drawings. The drawings show.

DETAILED DESCRIPTION OF THE INVENTION

Figure 1:
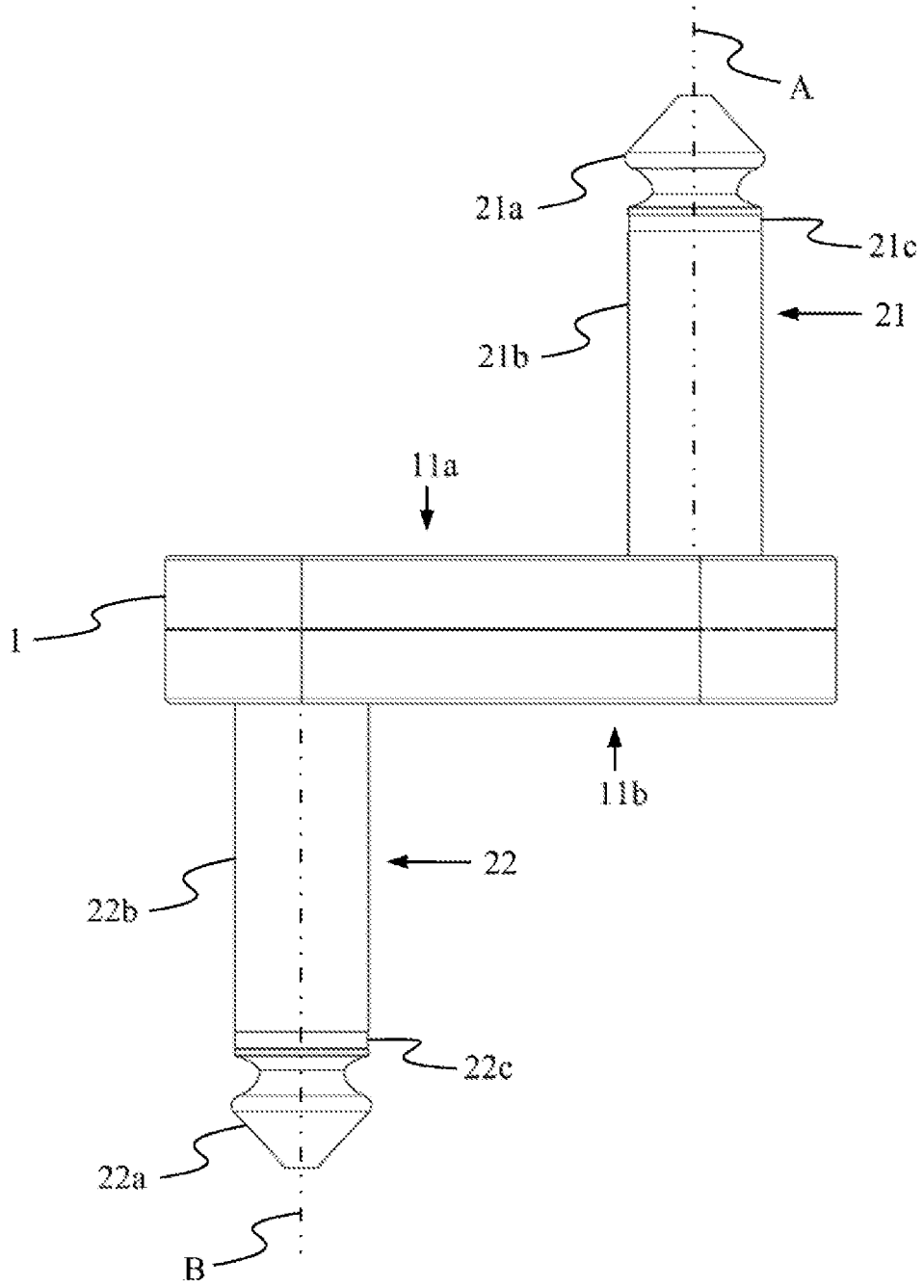
FIG. 1 shows a side view of a plug connector according to a first embodiment of the invention.

FIG. 1 is a side view of a plug connector according to a first embodiment of the invention. The plug connector has a housing 1, on which a first plug 21 and a second plug 22 are arranged.

In this embodiment, the first plug 21 and the second plug 22 are configured as two-pole jack plugs. Jack plug connections are frequently used to transmit audio signals, particularly from electronic instruments such as electric guitars or electric basses. As depicted in FIG. 1*a*, the poles of the plugs 21 and 22 are formed by tips 21*a*, 21*b* [sic] and rear cylindrical portions 21*b*, 22*b* of the plugs 21, 22 (the so-called sheaths), which are electrically insulated from one another by insulation rings 21*c*, 22*c*. The sheaths 21*b*, 22*b* are grounded. In the interior of the plugs 21, 22, provision is made of an electrical connection (not shown) of the tips 21*a*, 22*a* of the plugs 21, 22 to the respective opposite ends of the plugs, which end in an electric contact. This can be discerned in the second plug 22 in FIG. 3. In that figure, the electric contact for the tip 22*a* of the second plug 22 bears the reference sign 24. The first plug 21 is constructed similarly and has, on its end opposite the tip 21*a*, an electric contact 23, which is connected to the tip 21*a* by an electrical connection in the interior of the first plug 21.

The first plug 21 defines a plug-in direction A. In this embodiment, the first plug 21 is arranged on a first housing side 11*a*. The second plug 22 defines a plug-in direction B. The second plug 22 is arranged on a second housing side 11*b*, along which it is displaceable such that the relative position between the first plug 21 and the second plug 22 can be varied. Thus the relative positional relationship of the plug-in directions A and B to each other can likewise be varied.

The plug connector shown in FIG. 1 can be used, for example, to connect two devices that are arranged adjacently to one another in such a way that they have two essentially parallel surfaces facing one another. If a socket is provided on each of these surfaces, then the plug connector can also be used for connecting the two devices if the sockets are arranged offset to one another by sliding the second plug 22 along the second housing side 11*b*.

The height of the housing, i.e. the distance between the first housing side 11*a* and the second housing side 11*b*, is 10 mm in a preferred embodiment. The plug connector thus takes up little space and the devices to be connected can be arranged at very short distances from one another.

Figure 2A:
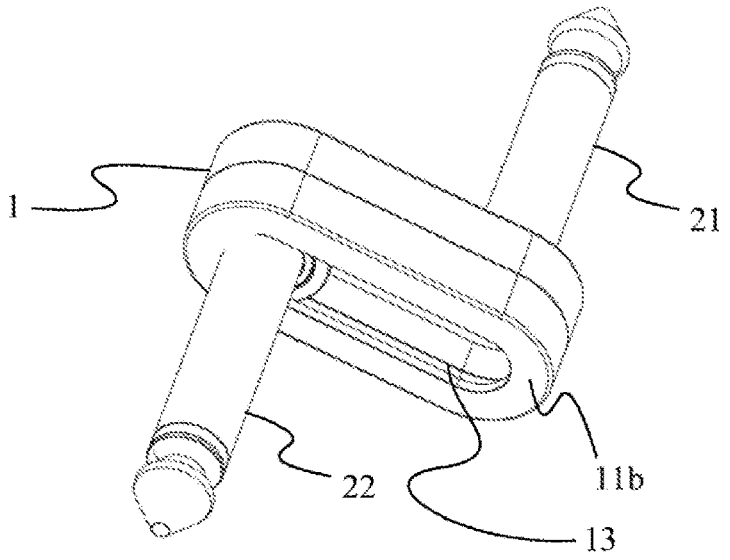
FIG. 2*a* shows a perspective view from below of the plug connector from FIG. 1.
Figure 2B:
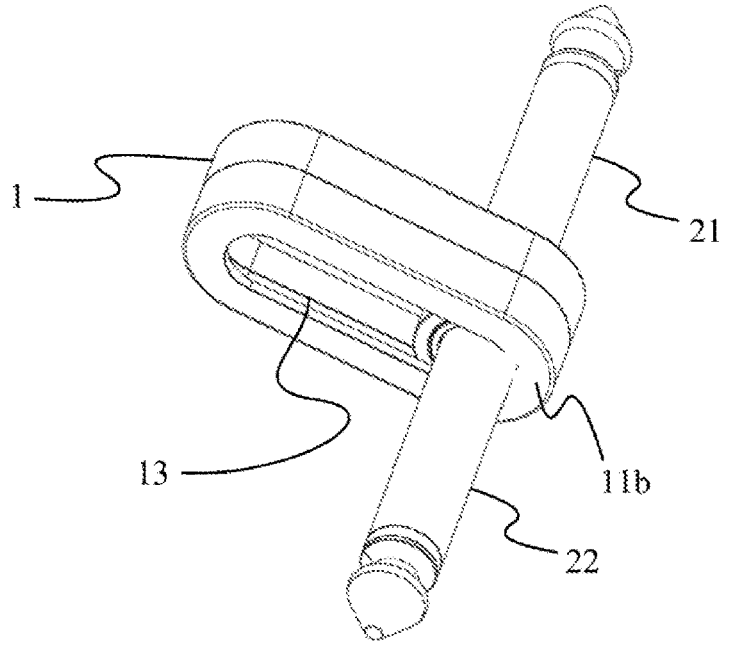
FIG. 2*b* shows the plug connector from FIG. 2*a* with an altered position of the second plug.

The slidability of the second plug 22 is illustrated in FIGS. 2*a* and 2*b*, which show a perspective view from below of the plug connector from FIG. 1. In FIG. 2*a*, the second plug 22 is situated in a position that has a maximum offset between the plug-in directions A and B. In FIG. 2*b*, the plug 22 is situated in a position in which the plug-in directions A and B lie on a straight line. With this arrangement of the second plug 22, it is possible to connect two sockets that are aligned with one another.

As can be discerned in FIGS. 2*a* and 2*b*, the end of the second plug 22 facing the housing 1 is mounted on the second housing side 11*b* in a guide slot 13, in which the slidable second plug 22 is guided. The guide slot 13 has a width that corresponds to the outer diameter of the second plug 22. This ensures that the second plug 22 can only be slid along the guide slot 13 and does not have any play in a direction perpendicular to that of the guide slot 13.

Figure 3:
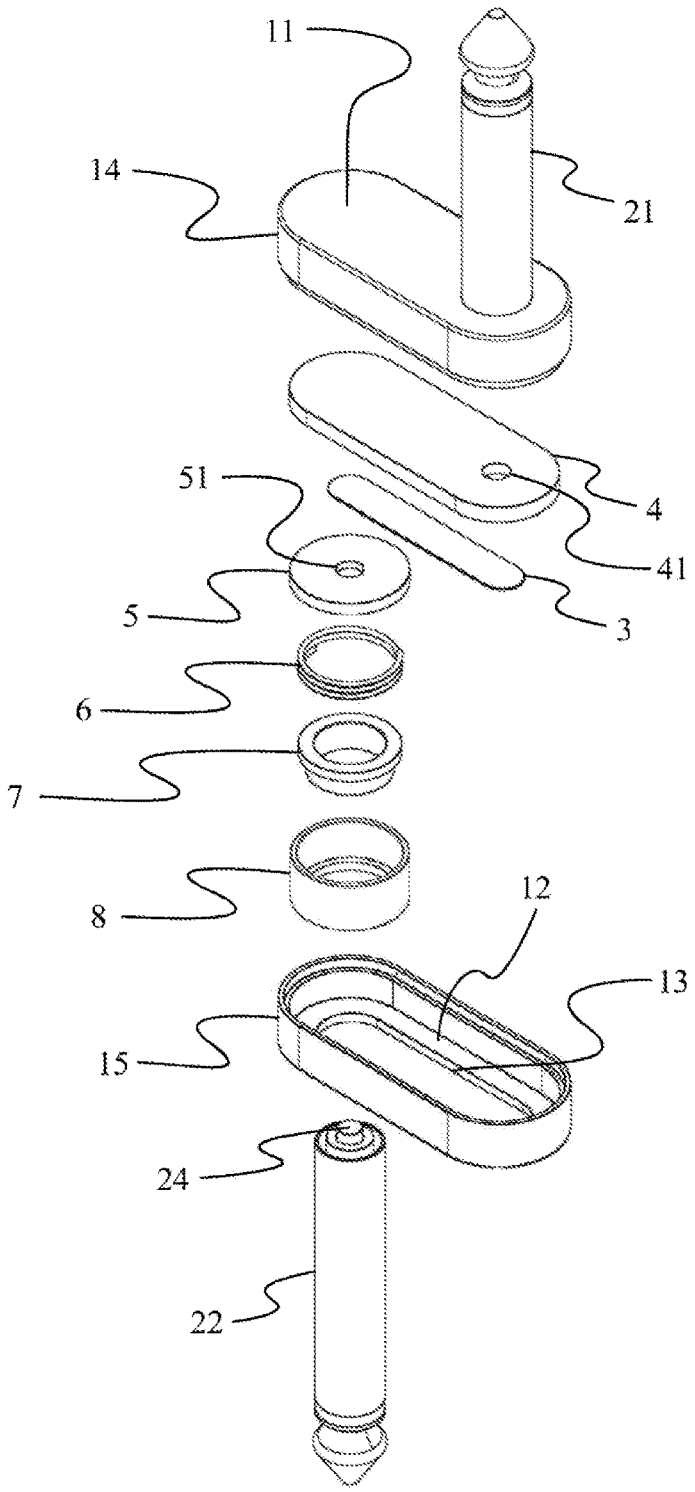
FIG. 3 shows an exploded view of the plug connector from FIG. 1.

FIG. 3 is an exploded view of the plug connector from FIG. 1. The housing 1 is formed by a first half shell 14 and a second half shell 15, which are inserted one on top of the other or glued or screwed together, or connected to one other in some other manner.

The first half shell 14 and the second half shell 15 are made of a conductive material such as metal. The first plug 21 is fixedly connected by its sheath 21*a* to the first half shell 14. The (not shown in FIG. 3) electric contact 23 of the first plug 21 faces the interior of the first half shell 14. On the inside, the second half shell 15 has a displacement surface 12 along which the second plug 22 can be slid.

In the embodiment shown FIG. 3, the second plug 22 is guided with its end arranged in the housing 1 by a cap 8, a ring 7, and a spring element 6. An insulating washer 5 is fixedly connected to the end of the second plug 22 arranged in the housing 1. The insulating washer 5 has a hole 51 in the center, through which the electric contact 24 of the second plug 22 protrudes in the assembled state. The cap 8 has a hollow cylindrical shape with an outer diameter that corresponds to the width of the housing 1 perpendicular to the guide slot 13.

On the side facing the guide slot 13, the cap 8 has a radially inwardly projecting edge. The ring 7 is likewise of hollow-cylindrical design and has an outer diameter that corresponds to the inner diameter of the cap 8 on the radially projecting edge. The inner diameter of the ring 7 corresponds to the outer diameter of the second plug 22. On its end facing the insulating plate 4, the ring 7 has a radially outwardly projecting edge.

An insulating plate 4 is arranged in the housing, on the side of the insulating washer 5 facing away from the second plug 22. The insulating plate 4 is made of an electrically insulating material, for example by a circuit board. A strip conductor 3, which is made of a conductive material, is provided on the side of the insulating plate 4 facing the second plug 22. In the exemplary embodiment shown, the strip conductor 3 is inlaid in a matching recess of the insulating plate 4 such that is flush with the surface of the insulating plate 4. However, the strip conductor 3 can also be imprinted or etched on the insulating plate 4.

The strip conductor 3 is arranged on the insulating plate 4 in such a way that in the assembled state, it extends parallel to the guide slot 13. This arrangement ensures that the electric contact 24 of the second plug 22 is always in contact with the strip conductor 3 when the plug 22 is slid along the guide slot 13.

To improve the electric contact further, the second plug 22 is additionally pre-tensioned toward the strip conductor 3, along the plug-in direction B. The pre-tension force is generated by the spring element 6. In the assembled state of the two housing shells 14 and 15, the side of the insulating plate 4 facing away from the strip conductor 3 abuts on the inside of the first half shell 14. At its housing-side end with the insulating washer 5 fixed thereon, the second plug 22 abuts on the insulating plate 4, wherein the electric contact 24 of the second plug 22 protrudes through the hole 51 of the insulating washer 5 and is in contact with the strip conductor 3.

The spring element 6 is arranged on the plug axis of the second plug 22 and in engagement with the insulating washer 5. Between the spring element 6 and the second housing shell 15, provision is made of the ring 7 and the cap 8, which are likewise arranged on the plug axis of the second plug 22. The spring element 6 engages with the edge of the ring 7 and presses it towards the guide slot 13. In this process, the edge of the ring 7 engages with the edge of the cap 8. Because the cap 8 has an outer diameter that is larger than the width of the guide slot 13, the engaged assembly of the ring 7 and the cap 8 is pre-tensioned by the spring element 6 against the inner wall of the second half shell 15. The spring element 6 simultaneously pre-tensions the second plug 22 towards the insulating plate 4.

The cap 8 and the ring 7 are made of a conductive material. The inner diameter of the ring 7 corresponds to the outer diameter of the second plug 22 in such a way that the sheath 22*b* of the second plug 22 is in conductive contact via the ring 7 and the cap 8 with the second half shell 15. The sheath 21*b* of the first plug 21 is in conductive contact with the first half shell 21 such that the sheaths 21*a*, 21*b* of the two plugs are conductively interconnected in the assembled state. The tip 22*b* of the second plug 22 is conductively connected via the electric contact 24 to the strip conductor 3. On the side facing away from the strip conductor 3, the insulating plate 4 has a hole 41 at a position that corresponds to the position of the electric contact 23 of the first plug 21. The strip conductor 3 extends over the hole 41 and is thus accessible from the side of the first plug 21. The electric contact 23 of the first plug 21 can be configured to fit the dimensions of the hole 41 so that the electric contact 23 can be plugged into the hole 41 in order to establish the contact with the strip conductor 3. As an alternative, the electric contact 23 can be soldered to or otherwise conductively connected to the strip conductor 3.

With the plug connector constructed in this manner, a connection is created between the plugs 21 and 22 without the use of cables, which has a simple and mechanically sturdy construction and permits a variable arrangement of the plug-in directions A and B to one another. With appropriate selection of the dimensions of the individual parts described, the plug connector can also be produced without the use of connecting means such as screws or the like.

In the embodiment described above, the displacement surface 12 is on the inside of the second half shell 15 parallel to the second housing side 11*b*, on which the second plug 22 is arranged. However, in principle it is also possible to configure the second housing side as non-parallel to the displacement surface 12. It is likewise conceivable to provide a construction in which the displacement surface 12, along which the plug 22 is slidably mounted, is on the outside of the housing. The crucial factor is merely that the second plug 22 is mounted slidably along a displacement surface.

It is furthermore possible to embody the mounting of the second plug 22 in the housing in another fashion. The crucial factor is merely that contact between the strip conductor 3 and the electric contact 24 of the second plug 22 is ensured in every position of the second plug 22. For example, it is conceivable to connect the insulating washer 5 in a non-fixed manner to the second plug 22 and instead design the ring element 6 [sic] so that it engages radially, in regions, with the second plug 22 while it pre-tensions the second plug 22 towards the strip conductor. Nor is it absolutely necessary to provide the combination of the ring 7 and the cap 8 as long as it is ensured that the second plug 22 is still slidable along the displacement surface 12. For example, this could be achieved by omitting the ring 7 and designing the spring element 6 so that it engages directly with the radially inwardly projecting edge of the cap 8 for pre-tensioning the second plug 22 towards the strip conductor 3.

Figure 4:
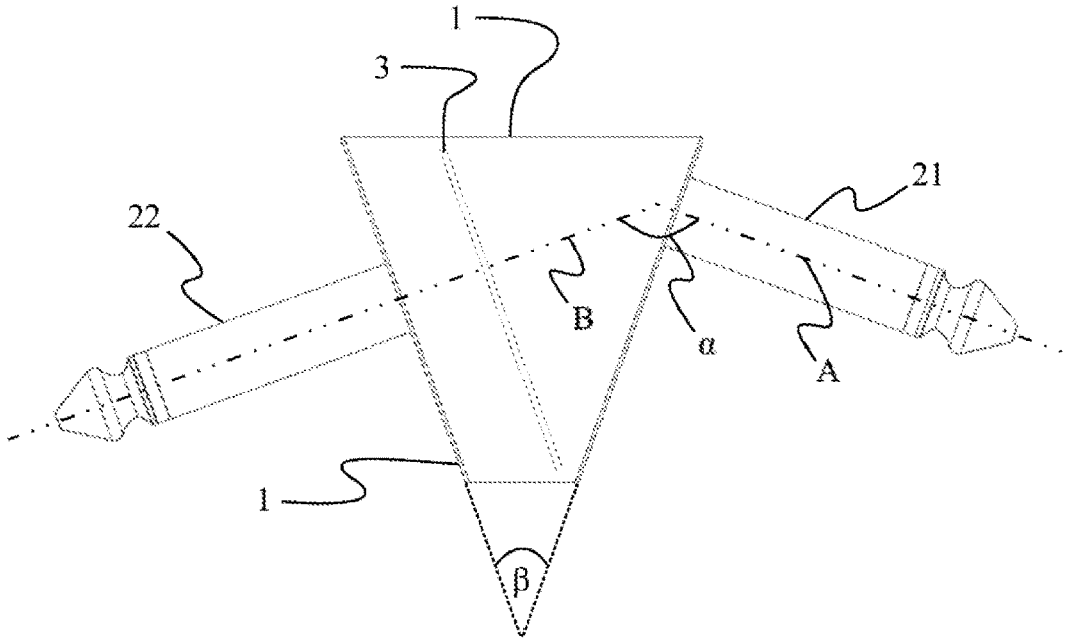
FIG. 4 shows a side view of a plug connector according to a second embodiment of the invention.

FIG. 4 is a side view of a plug connector according to the second embodiment of the invention. Whereas the first housing side 11*a* and the second housing side 11*b* were arranged parallel to each other in the first embodiment, the first housing side 11*a* and the second housing side 11*b* in the second embodiment mutually form an angle $\beta$. The angle $\beta$ is suitably an acute angle. The plug-in directions A and B of the plugs 21, 22 thus form an obtuse angle $\alpha$. This embodiment of the plug connector is an option when two devices to be interconnected are not arranged parallel to one another, for example on a crescent-shaped pedal board.

The structure of the plug connector in FIG. 4 essentially corresponds to that of the first embodiment. As indicated by dashed lines, the strip conductor 3 is again arranged in the interior of the housing in such a way that it extends parallel to the guide slot 13 in order to ensure that the second plug 22 is in electric contact in every position in the guide slot 13. To this end, the insulating plate 4 is fastened, for example screwed, inside the housing 1 at a suitable point. As an alternative, the housing 1 can have corresponding formations on the inside on which the insulating plate 4 is fastened. In the second embodiment, the electric contact 23 of the first plug 21 is connected in a suitable fashion to the strip conductor 3, for example by a conductor element of appropriate length.

Figure 5:
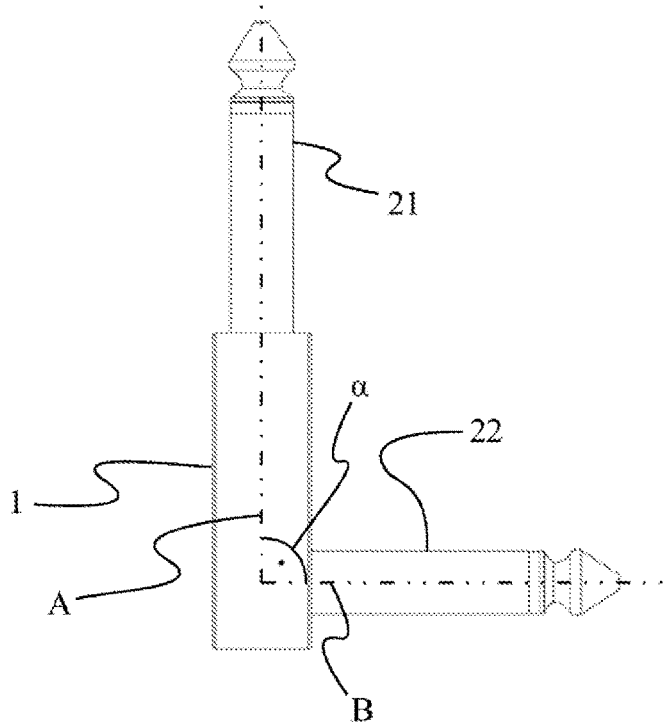
FIG. 5 shows a side view of a plug connector according to a third embodiment of the invention.

FIG. 5 is a side view of a plug connector according to the third embodiment of the invention. Unlike the first embodiment, the first plug 21 is not arranged on the housing side 11, but on a longitudinal end portion of the housing 1. It is thus possible to create a plug connector that can provide mutually perpendicular plug-in directions A, B.

The configuration of the plug connector from FIG. 5 corresponds to that of embodiment 1. Because the first plug 21 is mounted at a different position on the housing 1, the electric contact 23 is connected to the strip conductor 3 by provision of an appropriate conductor element. The arrangement of the insulating plate 4 and of the rest of the components corresponds to that of embodiment 1.

Figure 6:
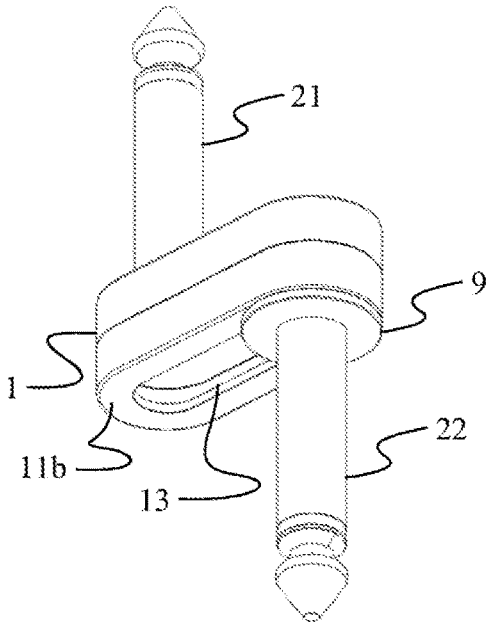
FIG. 6 shows a perspective view of a plug connector according to a fourth embodiment of the invention.

FIG. 6 is a perspective view of a plug connector according to a fourth embodiment of the invention. In structure, the plug connector corresponds to the plug connector according to the first embodiment. In the case of the plug connector in FIG. 6, a washer 9 is applied, preferably molded, on the second plug 22, which extends radially outward from the second plug 22 and is positioned such that it abuts on the second housing side 11*b*. The washer 9 is preferably made of the same material as the sheath 22*b* of the second plug [22]. The stability and the guiding of the second plug 22 in the guide slot 13 can be improved with the washer 9.

Figure 7:
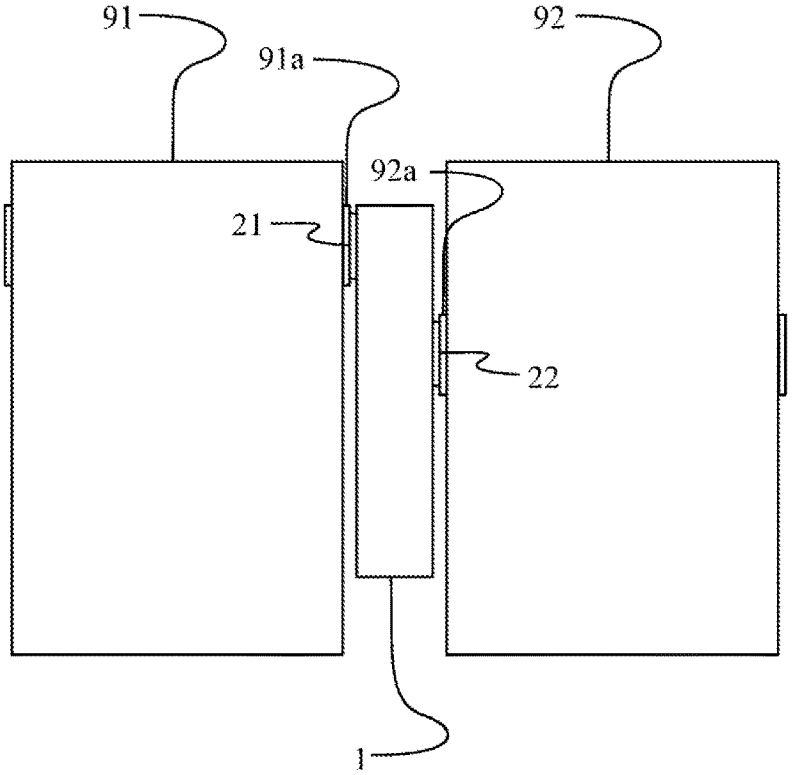
FIG. 7 shows a view from above of an assembly of two effect devices and a plug connector according to this invention.

FIG. 7 is a view from above of an assembly of two effect devices 91, 92 and a plug connector according to this invention. On their left and right side surfaces, the effect devices 91, 92 each have a socket 91*a*, 92*a*, which is configured for receiving a jack plug corresponding to the plugs 21, 22. The relative position of the sockets 91*a*, 92*a* on the side surfaces of the effect devices 91, 92 is different. However, by using a plug connector according to this invention, the two effect devices can be arranged adjacently to each other in a space-saving manner by plugging the first plug 21 of the plug connector into the socket 91*a* of the one effect device 91 and by sliding the slidable second plug 22 such that it can be plugged into the socket 92*a* of the second effect device 92 when the effect devices 91, 92 are in parallel alignment.

On their outwardly facing side surfaces in FIG. 6, the effect devices 91, 92 have additional sockets. With additional plug connectors, additional effect devices can be hooked up via these sockets. A signal chain can thus be formed out of any number of effect devices in a space-saving manner. If an angled arrangement of two effect devices is necessary, a plug connector according to the second embodiment of the invention can be used. Moreover, if an effect device has a socket on one of its end faces, a connection to an effect device with a socket on a longitudinal side of the effect device can be established with the plug connector according to the third embodiment.

LIST OF REFERENCE SIGNS

1 Housing
11*a* First housing side
11*b* Second housing side
12 Displacement surface
13 Guide slot
14 First half shell
15 Second half shell
21 First plug
22 Second plug
21*a*, 22*a* Tip
21*b*, 22*b* Sheath
23, 24 Electric contact
3 Strip conductor
4 Insulating plate
41 Hole
5 Insulating washer
51 Hole
6 Spring element
7 Ring
8 Cap
9 Washer
91, 92 Effect device
91*a*, 92*a* Socket
A, B Plug-in direction

What is claimed:

1. A plug connector having a housing, from which a first plug emerges, which is fixedly arranged relative to the housing, wherein a second plug is arranged on the housing that can be slid along a displacement surface of the housing for changing the relative position between the first plug and the second plug, and a strip conductor arranged in the housing, said strip conductor can be connected in an electrically conductive manner to an electric contact of the first plug and which is arranged such that an electric contact of the second plug is in contact with the strip conductor in every position of the second plug.

2. A plug connector according to claim 1, wherein the displacement surface has a guide slot for guiding the second plug.

3. A plug connector according to claim 1, wherein the strip conductor is arranged on the front side of an insulating plate that faces the guide slot.

4. A plug connector according to claim 3, wherein the insulating plate is formed by a circuit hoard and the strip conductor is imprinted on the insulating plate.

5. A plug connector according to claim 1, wherein the second plug has an insulating washer on its end arranged in the housing.

6. A plug connector according to claim 1, wherein the second plug, in particular the insulating washer, engages with a spring element, in such a way that the second plug can be pre-tensioned along its plug axis toward the strip conductor.

7. A plug connector according to claim 1, wherein a washer is molded on the second plug in such a way that it abuts on an outside of the housing in every position of the second plug.

8. A plug connector according to claim 1, wherein the first plug is arranged on a first housing side of the housing and the second plug is arranged on a second housing side of the housing, which is opposite the first housing side.

9. A plug connector according to claim 8, wherein the first housing side and the displacement surface are essentially parallel to one another.

10. A plug connector according to claim 8, wherein the first housing side and the displacement surface mutually form an acute angle (β).

11. A plug connector according to claim 1, wherein an angle (α) between a first plug-in direction (A) defined by the first plug and a second plug-in direction (B) defined by the second plug is 90°.

12. A plug connector according to claim 1, wherein an angle (α) between a first plug-in direction (A) defined by the first plug and a second plug-in direction (B) defined by the second plug is greater than 0°, preferably 180°.

13. A plug connector according to claim 1, wherein the first plug and the second plug are configured as jack plugs, preferably as two-pole jack plugs, more preferably as two-pole, 6.3 mm jack plugs.

14. A plug connector according to claim 1 further comprising at least two effect devices for modifying the electronic sound of a musical instrument, which each have at least one socket via which they are interconnected with one or several plug connectors.

15. An assembly comprising at least two effect devices for modifying the electronic sound of a musical instrument, each of the two effect devices including at least one socket via which they are interconnect using a plug connector, the plug connector having a housing, from which a first plug emerges, which is fixedly arranged relative to the housing, and wherein a second plug is arranged on the housing that can be slid along a displacement surface of the housing for changing the relative position between the first plug and the second plug, and a strip conductor arranged in the housing, said strip conductor can be connected in an electrically conductive manner to an electric contact of the first plug and which is arranged such that an electric contact of the second plug is in contact with the strip conductor in every position of the second plug.

* * * * *